US009762007B2

(12) United States Patent
Erdos et al.

(10) Patent No.: US 9,762,007 B2
(45) Date of Patent: Sep. 12, 2017

(54) PUSH ON CONNECTOR

(71) Applicant: DISH NETWORK L.L.C., Englewood, CO (US)

(72) Inventors: David Eugene Erdos, Parker, CO (US); David Michael Lettkeman, Parker, CO (US)

(73) Assignee: DISH Network L.L.C., Englewood, CO (US)

( * ) Notice: Subject to any disclaimer, the term of this patent is extended or adjusted under 35 U.S.C. 154(b) by 0 days.

(21) Appl. No.: 15/040,723

(22) Filed: Feb. 10, 2016

(65) Prior Publication Data

US 2017/0229822 A1 Aug. 10, 2017

(51) Int. Cl.

| | |
|---|---|
| ***H01R 13/658*** | (2011.01) |
| ***H01R 24/38*** | (2011.01) |
| ***H01R 4/48*** | (2006.01) |
| ***H01R 13/627*** | (2006.01) |

(52) U.S. Cl.

CPC ..... *H01R 24/38* (2013.01); *H01R 4/48* (2013.01); *H01R 13/6277* (2013.01)

(58) Field of Classification Search

CPC ..... H01R 24/38; H01R 4/48; H01R 13/6277
USPC ..... 439/349, 607.19, 607.17, 827, 253
See application file for complete search history.

(56) References Cited

U.S. PATENT DOCUMENTS 3,678,445 A * 7/1972 Brancaleone .... H01R 13/65802 439/607.17
4,120,557 A * 10/1978 Horrocks ..... H01R 13/15 439/827
4,128,293 A * 12/1978 Paoli ..... H01R 13/187 439/827
4,239,318 A * 12/1980 Schwartz ..... H01R 13/65802 439/607.18
4,326,768 A * 4/1982 Punako ..... H01R 13/65802 439/607.18

(Continued)

FOREIGN PATENT DOCUMENTS

| | | |
|---|---|---|
| DE | 8806594 U1 | 1/1989 |
| EP | 0342385 B1 | 9/1991 |

(Continued)

OTHER PUBLICATIONS

U.S. Appl. No. 13/352,608, New App. Transmittal, dated Jun. 25, 2012, 18 pages.

(Continued)

*Primary Examiner* — Abdullah Riyami
*Assistant Examiner* — Nelson R Burgos-Guntin
(74) *Attorney, Agent, or Firm* — Wash Park IP Ltd.; John T. Kennedy

(57) ABSTRACT

An RF connector is provided. The connector includes a first socket member. The first socket member includes a conductive sleeve and end cap. The conductive sleeve includes a top portion, a bottom portion, and a plurality of springs connecting the top portion and the bottom portion. A base inside the conductive sleeve includes a first matching hole configured to match to a first conductive pin of a first plug member. The end cap includes a base and a lip. In a first position, the top portion of the conductive sleeve contacts the base of the end cap and is partially enclosed by the lip of the end cap. The end cap prevents the removal of the conductive sleeve in the first position.

18 Claims, 8 Drawing Sheets

(56) References Cited

U.S. PATENT DOCUMENTS

| | | | | |
|---|---|---|---|---|
| 4,423,919 | A * | 1/1984 | Hillis | H01R 13/65802 439/607.17 |
| 4,655,533 | A * | 4/1987 | Haag | H01R 13/6583 29/520 |
| 4,750,897 | A | 6/1988 | Neidecker | |
| 4,752,253 | A | 6/1988 | Neumann et al. | |
| 4,846,731 | A | 7/1989 | Alwine | |
| 4,929,188 | A | 5/1990 | Lionetto et al. | |
| 4,936,795 | A * | 6/1990 | Kawai | H01R 13/655 439/607.19 |
| 5,439,386 | A | 8/1995 | Ellis et al. | |
| 5,653,615 | A | 8/1997 | Inaba et al. | |
| 5,658,171 | A | 8/1997 | Pauza et al. | |
| 5,695,357 | A | 12/1997 | Wright | |
| 9,802,937 | | 1/1998 | Kempf et al. | |
| 5,752,839 | A | 5/1998 | Fiacco et al. | |
| 5,951,337 | A | 9/1999 | Brake | |
| 6,174,206 | B1 | 1/2001 | Yentile et al. | |
| 6,227,868 | B1 | 5/2001 | Wlodarski | |
| 6,250,960 | B1 | 6/2001 | Youtsey | |
| 6,302,701 | B1 | 10/2001 | Miller et al. | |
| 6,332,815 | B1 * | 12/2001 | Bruce | H01R 13/6277 439/578 |
| 6,488,545 | B1 | 12/2002 | Meyer | |
| 6,609,931 | B2 | 8/2003 | Parrish et al. | |
| 6,719,586 | B2 | 4/2004 | Weidner | |
| 6,835,095 | B2 | 12/2004 | Chen | |
| 6,866,543 | B2 | 3/2005 | Chen et al. | |
| 6,899,563 | B1 | 5/2005 | Lee | |
| 7,306,484 | B1 | 12/2007 | Mahoney et al. | |
| 7,677,929 | B2 | 3/2010 | Bradford-Stagg | |
| 7,871,295 | B2 | 1/2011 | Zhang et al. | |
| 7,955,143 | B2 | 6/2011 | Zhang | |
| 8,035,466 | B2 | 10/2011 | Payne | |
| 8,083,544 | B2 | 12/2011 | Chee | |
| 8,162,672 | B2 | 4/2012 | Huang | |
| 8,172,617 | B2 | 5/2012 | Peng | |
| 8,221,161 | B2 * | 7/2012 | Leibfried, Jr. | H01R 13/6277 439/253 |
| 8,323,058 | B2 | 12/2012 | Flaherty et al. | |
| 8,333,595 | B2 | 12/2012 | Uesaka et al. | |
| 8,636,522 | B2 | 1/2014 | Sykes et al. | |
| 8,647,128 | B2 | 2/2014 | Sykes et al. | |
| 8,727,807 | B2 | 5/2014 | Sykes et al. | |
| 9,106,035 | B2 | 8/2015 | Erdos et al. | |
| 9,362,634 | B2 * | 6/2016 | Davidson, Jr. | H01R 9/0521 |
| 2002/0142625 | A1 | 10/2002 | Berghorn et al. | |
| 2006/0024993 | A1 | 2/2006 | Gonzalez | |
| 2006/0258225 | A1 | 11/2006 | Hsu | |
| 2008/0045043 | A1 | 2/2008 | Lee et al. | |
| 2009/0137133 | A1 | 5/2009 | Gou | |
| 2011/0104910 | A1 | 5/2011 | Kadomatsu et al. | |
| 2011/0165789 | A1 | 7/2011 | Sykes | |
| 2012/0164862 | A1 * | 6/2012 | Xu | H01R 13/11 439/253 |

FOREIGN PATENT DOCUMENTS

| | | | |
|---|---|---|---|
| EP | 0915536 | A2 | 5/1999 |
| WO | 2014/159112 | A1 | 10/2014 |

OTHER PUBLICATIONS

U.S. Appl. No. 13/352,608, Omitted Items Notice, dated Jul. 11, 2012, 3 pages.
U.S. Appl. No. 13/352,608, Preliminary Amendment, dated Sep. 10, 2012, 6 pages.
U.S. Appl. No. 13/352,608, Pre-Exam Formalities Notice, dated Sep. 18, 2012, 2 pages.
U.S. Appl. No. 13/352,608, Notice of Incomplete Reply, dated Sep. 19, 2012, 3 pages.
U.S. Appl. No. 13/352,608, Applicant's Response, dated Oct. 8, 2012, 14 pages.
U.S. Appl. No. 13/352,608, Pre-Exam Formalities Notice, dated Oct. 15, 2012, 2 pages.
U.S. Appl. No. 13/352,608, Notice of Incomplete Reply, dated Oct. 16, 2012, 3 pages.
U.S. Appl. No. 13/352,608, Applicant's Response, dated Nov. 1, 2012, 18 pages.
U.S. Appl. No. 13/352,608, Non-Final Office Action, dated Jul. 1, 2014, 10 pages.
U.S. Appl. No. 13/352,608, Applicant's Response, dated Apr. 7, 2014, 14 pages.
U.S. Appl. No. 13/352,608, Notice of Allowance, dated Jul. 1, 2014, 7 pages.
U.S. Appl. No. 13/352,608, Request for Continued Examination, dated Sep. 9, 2014, 5 pages.
U.S. Appl. No. 13/352,608, Non-Final Office Action, dated Oct. 20, 2014, 8 pages.
U.S. Appl. No. 13/352,608, Applicant's Response, dated Jan. 12, 2015, 7 pages.
U.S. Appl. No. 13/352,608, Final Rejection, dated Jan. 28, 2015, 10 pages.
U.S. Appl. No. 13/352,608, Applicant's Response, dated Mar. 20, 2015, 8 pages.
U.S. Appl. No. 13/352,608, Notice of Allowance, dated Apr. 2, 2015, 8 pages.
U.S. Appl. No. 13/352,608, Supplemental Notice of Allowance, dated Jul. 2, 2015, 2 pages.
U.S. Appl. No. 13/352,608, Issue Notification, dated Jul. 22, 2015, 1 page.
U.S. Appl. No. 13/831,513, New Application Transmittal, dated Mar. 14, 2013, 19 pages.
U.S. Appl. No. 13/831,513, Notice of Omitted Items, dated May 1, 2013, 3 pages.
U.S. Appl. No. 13/831,513, Applicant's Response, dated May 16, 2013, 26 pages.
U.S. Appl. No. 13/831,513, Non-Final Office Action, dated Jan. 2, 2014, 9 pages.
U.S. Appl. No. 13/831,513, Applicant's Response, dated Apr. 2, 2014, 14 pages.
U.S. Appl. No. 13/831,513, Non-Final Office Action, dated Jun. 13, 2014, 11 pages.
U.S. Appl. No. 13/831,513, Applicant's Response, dated Jul. 15, 2014, 8 pages.
U.S. Appl. No. 13/831,513, Notice of Allowance, dated Sep. 4, 2014, 8 pages.
U.S. Appl. No. 13/831,513, Request for Continued Examination, dated Sep. 16, 2014, 13 pages.
U.S. Appl. No. 13/831,513, Non-Final Office Action, dated Oct. 10, 2014, 7 pages.
U.S. Appl. No. 13/831,513, Applicant's Response, dated Jan. 12, 2015, 8 pages.
U.S. Appl. No. 13/831,513, Final Rejection, dated Feb. 6, 2015, 8 pages.
U.S. Appl. No. 13/831,513, Applicant Initiated Interview, dated Mar. 19, 2015, 3 pages.
U.S. Appl. No. 13/831,513, Applicant's Response, dated Apr. 3, 2015, 8 pages.
U.S. Appl. No. 13/831,513, Advisory Action, dated Apr. 16, 2015, 3 pages.
U.S. Appl. No. 13/831,513, Amendment after final initialed by Examiner, dated Apr. 16, 2015, 1 page.
U.S. Appl. No. 13/831,513, Request for Continued Examination, dated May 22, 2015, 3 pages.
U.S. Appl. No. 13/831,513, Non-Final Office Action, dated Jun. 9, 2015, 8 pages.
U.S. Appl. No. 13/831,513, Applicant's Response, dated Sep. 1, 2015, 6 pages.
U.S. Appl. No. 13/831,513, Notice of Allowance, dated Sep. 18, 2015, 7 pages.
U.S. Appl. No. 13/831,513, Issue Notification, dated Jan. 6, 2016, 1 page.
PCTUS2014021999, International Search Report, dated Oct. 2, 2014, 4 pages.

(56) References Cited

OTHER PUBLICATIONS

PCTUS2014021999, Written Opinion, dated Sep. 14, 2015, 7 pages.
PCTUS2014021999, International Preliminary Report on Patentability, dated Sep. 15, 2015, 8 pages.
CA2904434, Amendment, dated Nov. 18, 2015, 13 pages.
CA2904434, Office Action, dated Jun. 29, 2016, 4 pages.
CA2904434, Applicants Response, dated Dec. 22, 2016, 4 pages.
CN201400221036, Search Report, dated Sep. 12, 2016, 1 page.
CN201400221036, Office Action, dated Sep. 21, 2016 (English), 7 pages.
CN201400221036, Office Action, dated Sep. 21, 2016 (Chinese), 5 pages.
CN201400221036 Response dated Jan. 23, 2017, (Chinese) 16 pages.
CN201400221036 Response dated Jan. 23, 2017, English, 12 pages.
EP2973871 Comm Per Rules 161and 162 dated Oct. 23, 2015, 2 pages.
EP2973871 Applicants Response dated Apr. 21, 2016, 6 pages.
EP2973871 Invitation to Indicate Amendment basis dated Oct. 17, 2016, 2 pages.
EP2973871 Applicants Response dated Nov. 18, 2016, 5 pages.
EP2973871 Invitation to Indicate Amendment basis dated Dec. 5, 2016, 3 pages.
EP2973871 Applicants Response dated Jan. 5, 2017, 4 pages.
U.S. Appl. No. 14/751,971, New Application Transmittal dated Jun. 26, 2015, 22 pages.
U.S. Appl. No. 14/751,971, Non-Final Office Action dated Aug. 11, 2016, 12 pages.
U.S. Appl. No. 14/751,971, Applicant's Response dated Dec. 11, 2016, 21 pages.
U.S. Appl. No. 14/751,971, Terminal Disclaimer & Approval dated Jun. 26, 2016, 3 pages.
201700722942 Application as Filed Chinese, dated Feb. 10, 2017, 29 pages.
201700722942 Claims as filed English, dated Feb. 10, 2017, 5 pages.
201700722942 Filing receipt, dated Feb. 10, 2017, 2 pages.
EP171552219 Application as filed, dated Feb. 8, 2017, 24 pages.
EP171552219 Form 1002, dated Feb. 8, 2017, 1 page.
EP171552219 Request for Grant, dated Feb. 8, 2017, 5 pages.
EP171552219 Filing Receipt, dated Feb. 8, 2017, 2 pages.
EP2973871 Communication Per Article 94-3, dated Jan. 24, 2017, 5 pages.
U.S. Appl. No. 14/751,971 Final Office Action dated Mar. 7, 2017, 12 pages.
Tyco Electronics, "TE Connectivity F Series and G Series RF Connectors, 414766-5 Product Details", "TE Connectivity F Series and G Series RF Connectors, 414766-5 Product Details", Jun. 24, 2012, p. 2 Publisher: Tyco Electronics Corp.
CN201400221036 Notice of Allowance dated Jun. 9, 2017, Chinese, 2 pages.
EP2973871 Applicants Response dated May 24, 2017, 16 pages.
MXa2015012314 Office Action, Spanish, dated Apr. 21, 2017, 2 pages.
MXa2015012314_Applicants_Response, Spanish, dated Jun. 22, 2017, 8 pages.
MXa2015012314_Applicants_Response, Google Translation, dated Jun. 22, 2017, 4 pages.
EP171552219 Extended European Search Report and Preliminary Report on Patentability, dated Jun. 6, 2017, 12 pages.
English language translation of Abstract for EP0342385 B1 (Keller).
MXa2015012314 Office Action, English, dated Apr. 21, 2017, 2 pages.

* cited by examiner

PUSH ON CONNECTOR

TECHNICAL FIELD

The various embodiments disclosed herein generally relate to radio frequency ("RF") connectors. More specifically, the various embodiments relate to an RF connector with a first socket member configured to connect to a cable and a second socket member configured to connect to testing equipment.

BACKGROUND

An RF connector is an electrical connector that works at radio frequencies. RF connectors are typically used with coaxial cables and are designed to maintain the shielding that the coaxial design offers. Mechanically, the RF connector provides a fastening mechanism. There are various types of RF connectors including a female type RF connector and a male type RF connector. The female type (F-type) RF connector is generally a receptacle that receives and holds the male type RF connector. The female type RF connector is a connector that has a pin hole for receiving a conductive pin from a male type RF connector to provide electrical connection. The connector also includes mechanical fastening mechanism. For example, the female type RF connector may have outer threads configured to be received by the male type RF connector with inner threads.

One commonly used female type RF connector has two socket members adapted to connect to two plug members for male type RF connectors. Each plug member has a conductive pin, while a socket member has receptacle hole for receiving the conductive pin. Specifically, the plug member includes a protruding pin that fits into a matching hole in the socket member, where the hole may be sized to match to the protruding pin of the plug member. The plug member and the socket member are named based upon common electrical plugs and sockets. Generally, an electrical plug is a movable connector attached to an electrically operated device's power cord, and an electrical socket is fixed on equipment or a building structure.

FIG. 1 illustrates a side view of a conventional female type RF connector. As shown, conventional female type RF connector 100 includes a first socket member 102, a second socket member 104, and a middle portion 106 between the first socket member 102 and the second socket member 104. Inside the conventional connector 100, there is a pin hole 108 (shown as dashed line) with a conductive contact 110. The pin hole 108 is configured to receive a conductive pin from a male type RF connector. The female type RF connector is fastened to the male type RF connectors through threads. The socket members 102 and 104 include outer threads 112 adapted to fasten to the male type RF connectors.

The female type RF connector 100 may be used to connect a cable to a testing equipment. For example, socket member 102 may be connected to the cable with a male type RF connector. Socket member 104 may be connected to a male type RF connector for the testing equipment.

It is desirable to have a more convenient way for connecting the testing equipment to the cable to improve testing efficiency. Thus, there remains a need for developing alternative female type RF connectors.

SUMMARY

The various embodiments described herein provide a female type RF connector with a push-on connection. The push-on connection allows for the quick removal and insertion of the RF connector to a testing cable. This saves an operator or a user time when connecting cables to a tester, especially for frequent usage, and improves testing efficiency.

In one embodiment, an RF connector is provided. The connector includes a first socket member. The first socket member includes a conductive sleeve comprising a top portion, a bottom portion, and a plurality of springs connecting the top portion and the bottom portion. The first socket member also includes a base inside the conductive sleeve comprising a first matching hole configured to match to a first conductive pin of a first plug member. The connector also includes a second socket member. The second socket member includes a second matching hole configured to match to a second conductive pin of a second plug member, and a conductive body having outer threads configured to match to inner threads of the second plug member. The connector further includes a middle portion connected between the first socket member and the second socket member. The middle portion extends radically outwardly from a periphery of the middle portion.

In another embodiment, an RF connector is provided. The connector includes a first socket member. The first socket member includes a conductive sleeve comprising a top portion, a bottom portion, and a plurality of springs connecting the top portion and the bottom portion. The first socket member also includes a base inside the conductive sleeve comprising a first matching hole configured to match to a first conductive pin of a first plug member. The connector also includes a second plug member. The second plug member includes a second conductive pin configured to match to a second matching hole of a second socket member, and a conductive body having outer threads configured to match to inner threads of the second plug member. The connector further includes a middle portion connected between the first socket member and the second plug member. The middle portion extends radically outwardly from a periphery of the middle portion.

In another embodiment, an RF connector is provided. The connector includes a first socket member. The first socket member includes a conductive sleeve and an end cap. The conductive sleeve includes a top portion, a bottom portion, and a plurality of springs connecting the top portion and the bottom portion. The first socket member also includes a base inside the conductive sleeve. The base inside the conductive sleeve includes a first matching hole configured to match to a first conductive pin of a first plug member. The end cap includes a base and a lip. The top portion of the conductive sleeve is configured to contact the base of the end cap when the RF connector is situated in a first position. The end cap prevents the removal of the conductive sleeve when the RF connector is situated in the first position.

Additional embodiments and features are set forth in part in the description that follows, and in part will become apparent to those skilled in the art upon examination of the specification or may be learned by the practice of the various embodiments taught. A further understanding of the nature and advantages of the of the various embodiments taught may be realized by reference to the remaining portions of the specification and the drawings, which forms a part of this disclosure.

DETAILED DESCRIPTION

Figure 1:
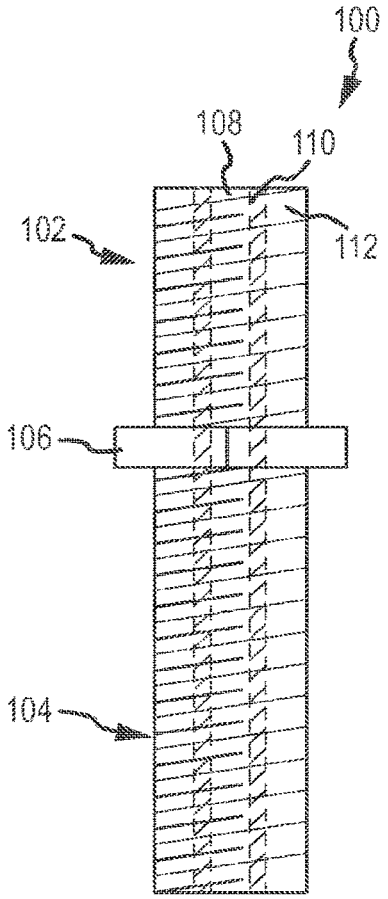
FIG. 1 (PRIOR ART)
FIG. 1 illustrates a side view of a conventional female type RF connector.

The present disclosure may be understood by reference to the following detailed description, taken in conjunction with the drawings as briefly described below. It is noted that, for purposes of illustrative clarity, certain elements in the drawings may not be drawn to scale.

This disclosure provides various embodiments of a female type RF connector with a push-on connection. The push-on connection is configured to connect to a cable for testing. In accordance with at least one embodiment, the female type RF connector may also include a socket member or a plug member configured to connect to a testing equipment. In at least one embodiment, the socket member or the plug member is coupled to the push-on connection through a middle portion. In at least one embodiment, the socket member comprises an end cap that prevents the removal of a conductive sleeve when decoupling the socket member from a plug member of a male type RF connector.

Figure 2A:
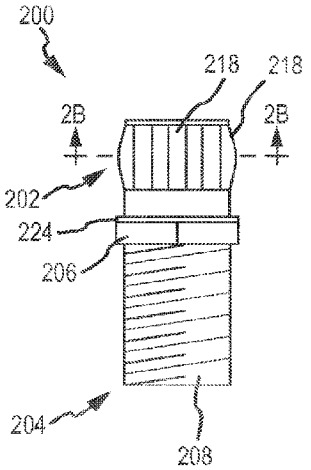
FIG. 2A illustrates a side view of an assembled female type RF connector in an embodiment.

FIG. 2A illustrates a side view of an assembled female type RF connector in an embodiment. A F-type RF connector 200 includes a first socket member or a push-on connection 202 configured to connect to a first plug member for a first male type RF connector, such as for a cable. The F-type RF connector 200 also includes a second socket member 204 configured to connect to a second plug member for a second male type RF connector, such as for a tester. The F-type RF connector 200 further includes a middle portion 206 between the first socket member 202 and the second socket member 206. The middle portion 206 functions as a stop for both the first plug member and the second plug member. In accordance with at least one embodiment, the middle portion 206 may be shaped like a nut. The second socket member 204 includes outer threads 208 to fasten to a plug member for a male type RF connector.

It is contemplated that the second socket member being a female type connector may instead be a second plug member being a male type connector. The second plug member would be configured to connect to a female type socket member, such as one being used by a tester.

Figure 2B:
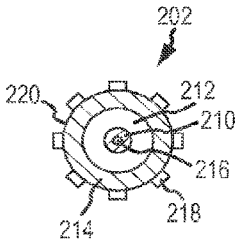
FIG. 2B illustrates a top view of the assembled female type RF connector of FIG. 2A.
Figure 4A:
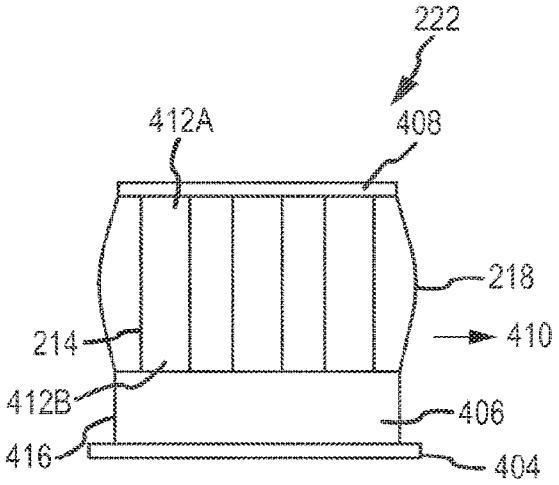
FIG. 4A illustrates a side view of a conductive sleeve in an embodiment.
Figure 4B:
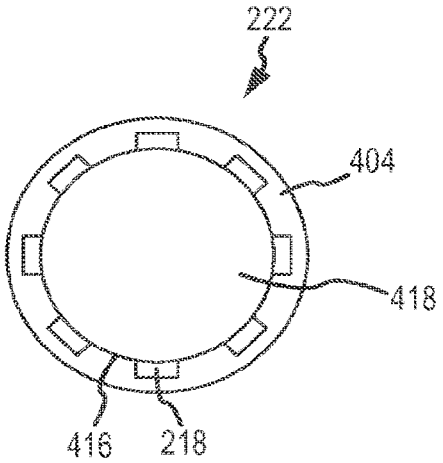
FIG. 4B illustrates a top view of the conductive sleeve of FIG. 4A.

FIG. 2B illustrates a sectional view of the F-type RF connector 200. As shown, the push-on connection 202 includes a conductive sleeve 222 (see FIGS. 4A-4B) having a number of springs 218 spaced on a periphery 220 of the push-on connection 202. An exemplary detailed structure of the conductive sleeve 222 is illustrated in FIGS. 4A-4B (see below). As shown in FIG. 2A, the push-on connection 202 may also include a flange 224, which may sit against the middle portion 206. As shown in FIG. 2B, the push-on connection 202 also includes a dielectric layer 212 inside the conductive sleeve 222. The push-on connection 202 further includes a conductive contact layer 210 surrounding a pin hole 216. The pin hole 216 may be sized to match a conductive pin of the first plug member. The conductive contact layer 210 contacts a conductive pin of the first plug member from a male type RF connector to provide electrical connection. The conductive sleeve 222 is configured to contact conductive threads of the first plug member to provide an electrical connection. The dielectric layer 212 separates a conductive body layer 214 from the conductive contact layer 210. The dielectric layer 212 may be made of a plastic or an insulator. The conductive sleeve 222 may be formed of metal casting, such as zinc plated steel or other suitable metal alloy.

Figure 2C:
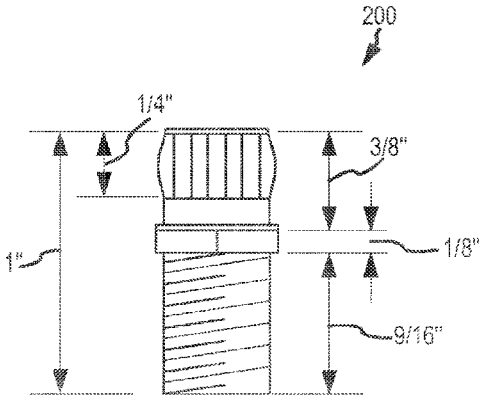
FIG. 2C illustrates exemplary dimension for the assembled female type RF connector of FIG. 2A.

FIG. 2C illustrates exemplary dimensions of the F-type RF connector 200. As shown, the overall height of the connector 200 may be one inch. The springs 218 may be 0.25 inches long after being compressed and 0.375 inches long before being compressed. The middle portion 206 may have a height of 0.125 inches. The push-on connection 202 may be 0.375 inches high and the second socket member 204 may be 9/16 inches high. It will be appreciated by those skilled in the art that the F-type RF connector may vary in shape and dimensions.

The F-type RF connector may be fabricated by assembling a base component and a conductive sleeve. FIG. 3A illustrates a side view of a base component for the F-type RF connector 200 in an embodiment. Base component 300A includes an adaptor base 302A and a second socket member 204. The adaptor base 302A may be configured to have the conductive sleeve 222 to press fit on. For example, the adaptor base 302A may have an outer surface 304 without any threads such that the conductive sleeve 222 may be pressed fit to the outer surface 304. Base component 300A also includes a middle portion 206 between the adaptor base 302A and the second socket member 204. Again, the second socket member 204 includes outer threads 208 to fasten to a plug member for a male type RF connector.

Figure 3B:
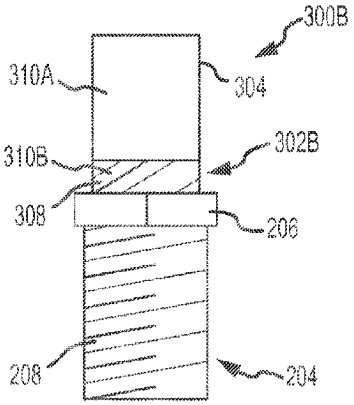
FIG. 3B illustrates a side view of a threaded base for a female type RF connector in an embodiment.

FIG. 3B illustrates a side view of a threaded base for a female type RF connector 200 in an alternative embodiment. Base 300B is similar to base 300A except that the adaptor base 302B includes a top portion 310A without threads and a bottom portion 310B with threads 308. The conductive sleeve 222 may have inner threads that are matched to the outer threads 308 of the bottom portion 310B of the adaptor base 302B to help fasten the conductive sleeve 222 to the base 300B.

Figure 3D:
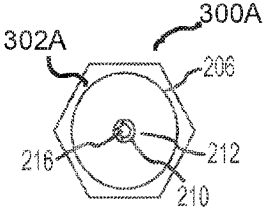
FIG. 3D illustrates a top view of the press fit base of the female type RF connector of FIG. 3A in an embodiment.
Figure 3A:
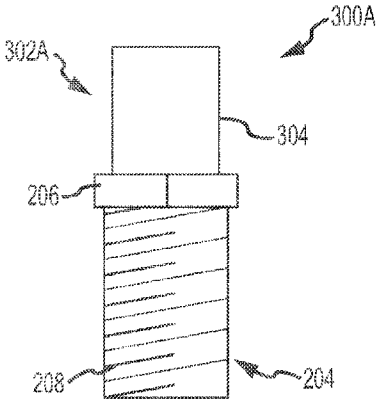
FIG. 3A illustrates a side view of a press fit base for a female type RF connector in an embodiment.
Figure 3C:
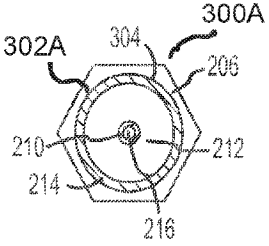
FIG. 3C illustrates a top view of the press fit base of the female type RF connector of FIG. 3A in an embodiment.

FIG. 3C illustrates a top view of the base component 300A in one embodiment. As shown, the adaptor base 302A includes a conductive body layer 214 enclosing dielectric layer 212 and inner conductive contact layer 210 surrounding pin hole 216. The conductive body layer 214 may be formed of metal casting, such as zinc plated steel or other suitable metal alloy. As shown in FIG. 3C, the middle portion 206 may be shaped like a nut. It will be appreciated by those skilled in the art that the middle portion may vary in shape or dimension.

FIG. 3D illustrates a top view of the base component 300A in an embodiment. As shown, the adaptor base 302A includes a dielectric layer 212 and inner conductive contact layer 210 surrounding pin hole 216. As shown in FIG. 3D, the middle portion 206 may be shaped like a nut. Note that the conductive body layer 214 shown in FIG. 3C may not be necessary, as the conductive sleeve 222 provides the electrical contact to a plug member. It will be appreciated by those skilled in the art that the middle portion may vary in shape or dimension.

It will be appreciated that in an alternative embodiment, base component 300B may be used in the place of base component 300A in FIGS. 3C and 3D except that outer threads 308 of the bottom portion 310B component would not be shown.

It is further contemplated that the second socket member 204 may include outer conductive body layer 214 with outer threads 208. The second socket member 204 may also include dielectric layer 212 inside the outer conductive body layer 214 and inner conductive layer 210 enclosing pin hole 216. The pin hole 216 may be sized to match to a conductive pin of a second plug member. The outer conductive body layer with threads 208 are configured to fit into a hollow barrel of the second plug member.

The push-on connection 202 may be formed by pressing conductive sleeve 222 (as shown in FIGS. 4A and 4B) onto the adaptor base 302A or 302B of the base component 300A or 300B (as shown in FIGS. 3A and 3B) until the conductive sleeve 222 contacts the middle portion 206.

FIG. 4A illustrates a side view of conductive sleeve 222 in an embodiment. The conductive sleeve 222 includes a number of springs 218 that are slightly bent extending outwardly in a radial direction as shown by arrow 410. The conductive sleeve 222 also includes a top portion 408 and a bottom portion 406 coupled to a flange 404 extending outwardly in a radial direction. Each spring 218 has a first end 412A connected to the top portion 408, and a second end 412B connected to the bottom portion 406. As shown in FIG. 4A, the springs 218 are arched such that the center of the springs extend the most distance. The springs 218 are configured to be flexible between two ends 412A and 412B. When the push-on connection 202 is pushed into a plug member for a male type RF connector, the springs 218 would be deformed to make contact with threads of the plug member.

Figure 8:
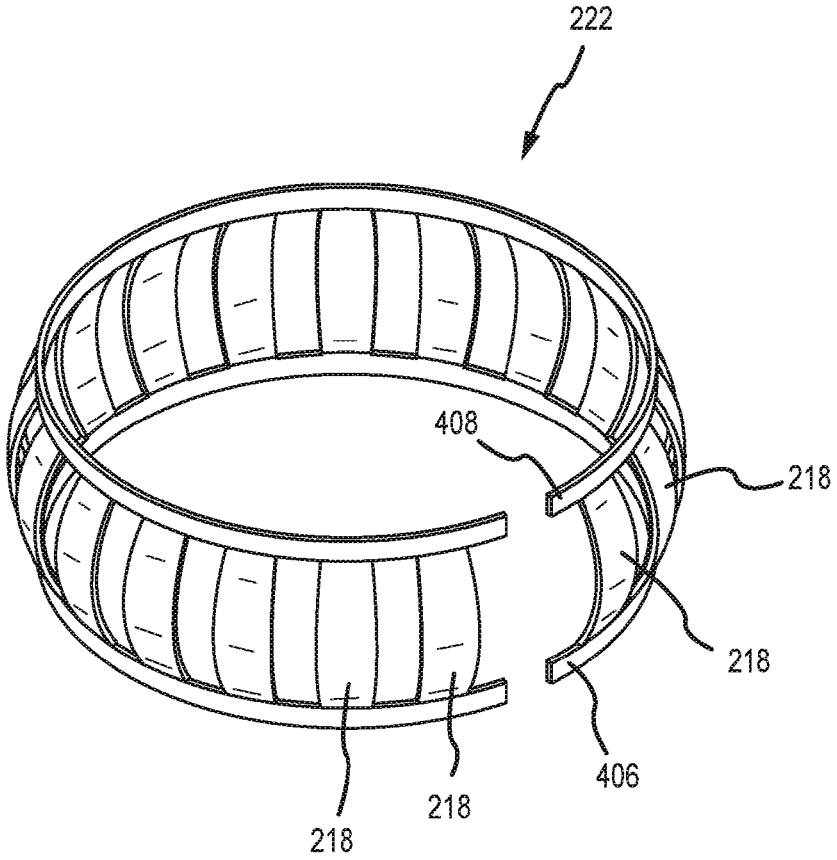
FIG. 8 illustrates an isometric view of a conductive sleeve in an embodiment.

The conductive sleeve 222 may be fabricated by cutting a number of strips from a cylindrical tube to form the springs 218. Then, the conductive sleeve 222 is compressed slightly to form the shape as shown in FIG. 4A. Alternatively, the conductive sleeve 222 may be fabricated by cutting a number of strips from a flat piece of material to form non-deformed springs, and the flat piece may then be formed into a cylindrical shape and then compressed to make deform the springs, making a cuff as shown in FIG. 8. This embodiment of the conductive sleeve allows for easy installation and removal of the conductive sleeve in the assembly and repair of connector 200.

FIG. 4B illustrates a sectional view of the conductive sleeve 222 in an embodiment. The flange 404 may be substantially circular shaped. The flange 404 may help attach the conductive sleeve 222 to the middle portion 206 of the F-type RF connector 200. The springs 218 are spaced along periphery 416 of the conductive sleeve 222. The conductive sleeve 222 includes an opening 418 inside the conductive sleeve 222 to receive the adaptor base 302A or 302B. The opening 418 may be sized to match to outer surface 304 of the base component 302A or 302B. Note that the springs 218 extend outwardly from periphery 416.

Figure 5:
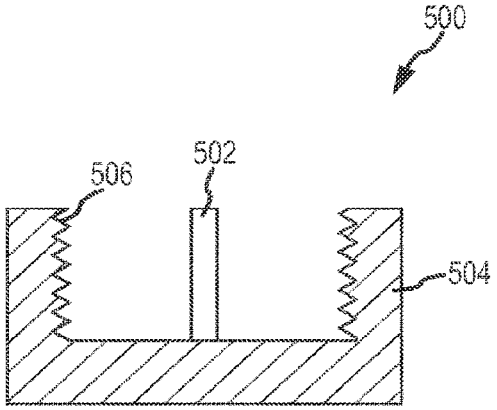
FIG. 5 illustrates a side view of a simplified plug member in an embodiment.

FIG. 5 illustrates a side view of a simplified second plug member 500 in an embodiment. The second plug member 500 may be used to connect to a tester. The second plug member 500 includes a conductive pin 502 and a conductive housing 504 with inner threads 506. The conductive housing 504 is shaped like a hollow barrel and encloses the conductive pin 502. The second socket member 204 of the connector 200 is configured to match to the second plug member 500 such that the pin hole 216 receives the conductive pin 502 of the connector 200 and the outer threads 208 of the second socket member 204 tightens to the inner threads 506 of the second plug member 500.

Figure 6:
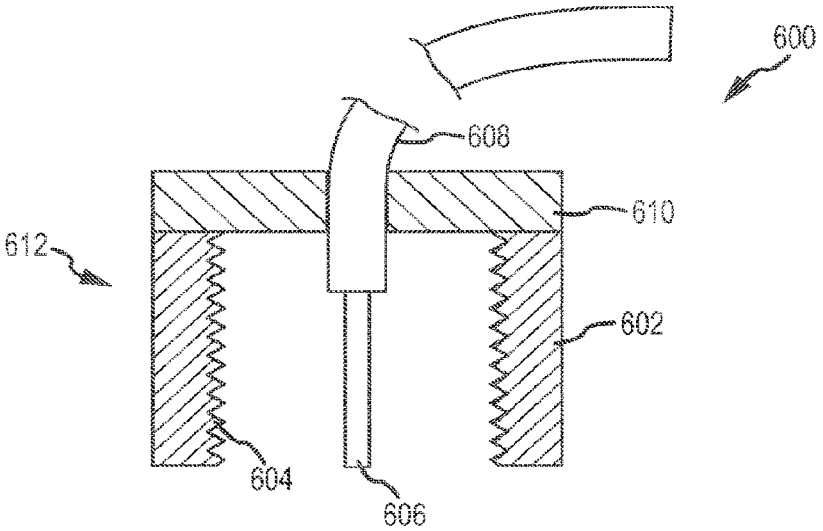
FIG. 6 illustrates a side view of a simplified plug member in an embodiment.

FIG. 6 illustrates a side view of a simplified first plug member 600 in another embodiment. The first plug member 600 includes a conductive housing 612 and a cable 608 coupled with a conductive pin 606. The conductive housing 612 also includes a first portion 602 shaped like a hollow barrel. The conductive pin 606 is enclosed within the hollow barrel. The conductive housing 612 also includes a second portion 610 attached to the first portion 602. The first portion 602 has threads 604 inside the conductive housing 612. The second portion 610 includes an opening in a center of the second portion 610 configured to allow the cable 608 to pass through. The push-on connection 202 may be pushed into first plug member 600 such that the inner threads 604 of the first plug member 600 contact the springs 218 of the conductive sleeve 222 of the connector 200.

For testing a cable 608 using the F-type RF connector 200, the first plug member 600 is connected to the push-on connection or first socket member 202, while the second plug member 500 is connected to the second socket member 204 so that the cable 608 is connected to a tester (not shown). For testing multiple cables, the push-on connection 202 may be easily pulled out from the housing 612 of a first cable while the conductive pin 606 of the first cable 608 is separated from the matching hole 216 of the push-on connection or first socket member 202. Then, the push-on connection 202 may be easily pushed into a conductive housing 612 of a second cable 608, while a conductive pin 606 of the second cable 608 is inserted into the matching hole 216 of the push-on connection or first socket member 202. Such pull and push actions are easier and faster than removal or insertion by threading. This type of F-type RF connector would save operator time especially for frequent removal of the cable from the RF connector.

In an alternative embodiment, the F-type RF connector 200 may also have a plug member (not shown) for connecting to a testing equipment. For example, the testing equipment has a socket member (not shown). The plug member of the connector 200 may be an electrical plug with a conductive pin surrounded by a hollow barrel having a threaded inside wall. The socket member of the testing equipment is configured to receive the conductive pin of the electrical plug of the connector 200. The socket member of the testing equipment also has outer threads configured to fasten against the threaded inside wall of the electrical plug or plug member of the connector 200.

The push-on connection of the F-type RF connector can be easily inserted into the plug member or removed easily from the plug member. The springs may be durable even with frequent usage of the push-on connection. Comparing to the conventional threading connection, the easy insertion and removal of the push-on connection into the plug member saves a user setup time for any testing.

Figure 7A:
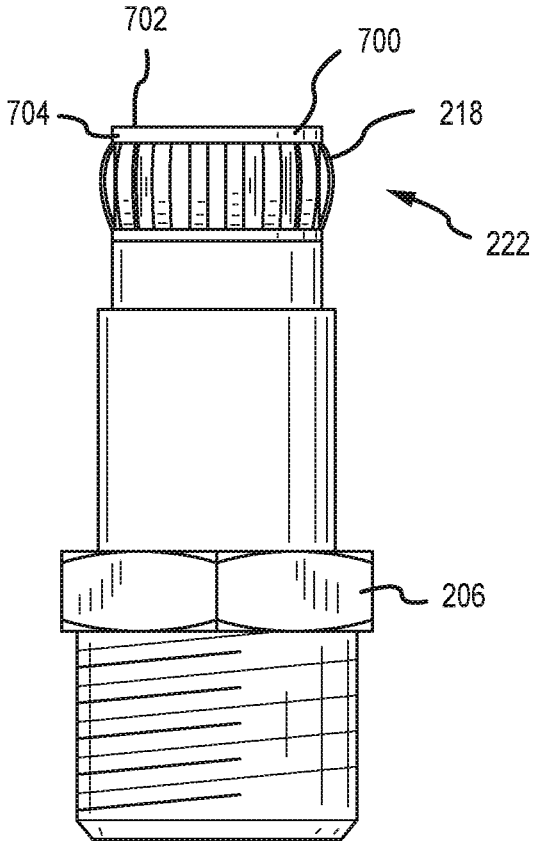
FIG. 7A illustrates a side view of an assembled female type RF connector in an embodiment.
Figure 7B:
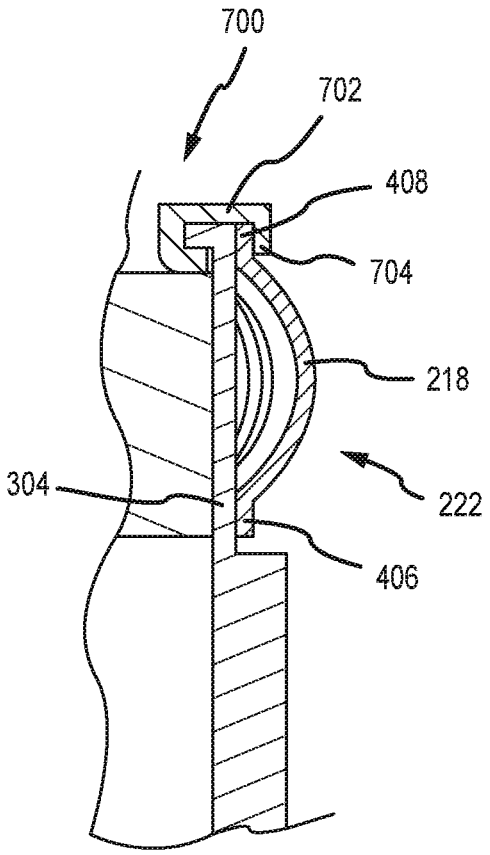
FIG. 7B illustrates a cross-sectional view of the assembled female type RF connector of FIG. 7A.

FIGS. 7A and 7B describe an embodiment of an F-type RF connector which comprises an end cap 700 that engages with the top portion 408 of the conductive sleeve 222. The end cap 700 may comprise a base 702 and lip 704. When the push-on connection 202 is pulled away from the plug member of a male type RF connector, the conductive sleeve 202 may slide on the outer surface 304, away from the middle portion 206 and towards the base 702. At this first position, as shown in FIG. 7B, the top portion 408 of the conductive sleeve 222 may contact the base 702 and may contact an inside surface of the lip 704 so that the conductive sleeve is prevented from sliding off of the push-on connection 202.

When the push-on connection 202 is pushed into a plug member for a male type RF connector, the springs 218 are deformed to make contact with threads of the plug member, and the conductive sleeve 222 slides down the outer surface 304, away from the base 702 and towards the middle portion 206. At this second position, the top portion 408 of the conductive sleeve 222 may not be in contact with the base 702 but may still be radially surrounded by the lip 704. The conductive sleeve 222 shown in FIG. 8 may slidably move in between the first position and the second position.

Having described several embodiments, it will be recognized by those skilled in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. An RF connector comprising a first socket member, wherein the first socket member comprises a conductive sleeve and an end cap;

the conductive sleeve comprises a top portion, a bottom portion, and a plurality of springs connecting the top portion and the bottom portion, a base inside the conductive sleeve comprises a first matching hole configured to match to a first conductive pin of a first plug member;

wherein the end cap comprises a base and a lip;

wherein the top portion of the conductive sleeve is configured to contact the base of the end cap when the RF connector is situated in a first position; and whereby the end cap prevents the removal of the conductive sleeve when the RF connector is situated in the first position.

2. The RF connector of claim 1, wherein the conductive sleeve is moved into the first position when the first plug member is disengaged from the first socket member.

3. The RF connector of claim 1, wherein the end cap lip partially encloses the top portion of the conductive sleeve.

4. The RF connector of claim 3, wherein the conductive sleeve is removable.

5. The RF connector of claim 3, wherein the conductive sleeve is in a second position when the first plug member is not engaged with the first socket member.

6. The RF connector of claim 5, wherein the conductive sleeve slidably moves between the first position and the second position.

7. The RF connector of claim 1, wherein a cuff shaped strip of material forms the conductive sleeve.

8. The RF connector of claim 1, wherein the first conductive pin is enclosed by a housing of the first plug member.

9. The RF connector of claim 8, wherein the plurality of springs are configured to contact inner threads of the housing of the first plug member.

10. The RF connector of claim 1, wherein the plurality of springs are configured to contact inner threads of the first plug member when the first socket member is pushed against the plug member such that the first conductive pin of the first plug member fits into the first matched hole of the first socket member.

11. The RF connector of claim 1 further comprising a second socket member configured to match a second conductive pin of a second plug member; and a middle portion connected between the first socket member and the second socket member and extending radially outwardly from a periphery of the middle portion.

12. The RF connector of claim 1, further comprising a second plug member with a second conductive pin configured to match a second socket member;

a middle portion connected between the first socket member and the second plug member and extending radially outward from a periphery of the middle portion.

13. An RF connector comprising a first socket member, wherein the first socket member comprises a conductive sleeve and an end cap;

the conductive sleeve comprises a top portion, a bottom portion, and a plurality of springs connecting the top portion and the bottom portion, a base inside the conductive sleeve comprises a first matching hole configured to match to a first conductive pin of a first plug member, wherein the first conductive pin is enclosed by a housing of the first plug member;

the end cap comprises a base and a lip;

wherein the top portion of the conductive sleeve contacts the base of the end cap and is partially enclosed by the lip of the end cap;

wherein the end cap prevents the removal of the conductive sleeve when the first plug member is disengaged from the first socket member;

a second member; and a middle portion connected between the first socket member and the second member, the middle portion extending radically outwardly from a periphery of the middle portion.

14. The RF connector of claim 13, wherein the second member comprises a second socket member and a second matching hole configured to match to a second conductive pin of a second plug member, and a conductive body having outer threads configured to match to inner threads of the second plug member.

15. The RF connector of claim 13, wherein the second member comprises a second plug member with a second conductive pin configured to match a second socket member.

16. An RF connector comprising a first socket member, wherein the first socket member comprises a conductive sleeve and an end cap;

the conductive sleeve comprises a top portion, a bottom portion, and a plurality of springs connecting the top portion and the bottom portion, a base inside the conductive sleeve comprises a first matching hole configured to match to a first conductive pin of a first plug member, wherein the first conductive pin is enclosed by a housing of the first plug member;

the end cap comprises a base and a lip;

wherein a first position the top portion of the conductive sleeve contacts the base of the end cap and is partially enclosed by the lip of the end cap and the end cap prevents the removal of the conductive sleeve in the first position when the first plug member is disengaged from the first socket member;

wherein a second position the top portion of the conductive sleeve is not partially enclosed by the lip of the end cap and the end cap no longer prevents the removal of the conductive sleeve;

a second member with a conductive body having threads configured to match to threads of a second mating member; and a middle portion connected between the first socket member and the second member, the middle portion extending radically outwardly from a periphery of the middle portion.

17. The connector of claim 16, wherein the second member comprises a second socket member;

the second mating member comprises a second plug member;

the second socket member is configured to match to a second conductive pin of a second plug member, and the conductive body further comprises outer threads configured to match to inner threads of the second plug member.

18. The connector of claim 16, wherein the second member comprises a second plug member;

the second mating member comprises a second socket member;

the second plug member comprises a second conductive pin configured to match a second socket member; and the conductive body further comprises inner threads configured to match the outer threads of the second socket member.

* * * * *